US005205058A

United States Patent [19]

Allen et al.

[11] Patent Number: 5,205,058

[45] Date of Patent: Apr. 27, 1993

[54] ROADBED MAINTENANCE DEVICE

[76] Inventors: A. Gregory Allen, 4258 N. Old Hwy. 91; Frank T. Samarzea, 1119 N. Main #10, both of Pocatello, Id. 83204

[21] Appl. No.: 514,506

[22] Filed: Apr. 25, 1990

[51] Int. Cl.[5] ..... E01H 5/04

[52] U.S. Cl. ..... 37/231; 37/235; 37/196

[58] Field of Search ..... 37/231, 234, 235, 236, 37/272, 266, 279, 281, 283

[56] References Cited

U.S. PATENT DOCUMENTS

| | | | |
|---|---|---|---|
| 2,565,337 | 8/1951 | Allen | 37/279 |
| 2,645,866 | 7/1953 | McGee | 37/236 |
| 3,086,303 | 3/1963 | Weeks | 37/234 |
| 3,347,677 | 9/1982 | Küper | 37/233 |
| 3,432,449 | 3/1969 | Glesmann | 37/272 |
| 3,465,456 | 9/1969 | Meyer | 37/233 |
| 3,746,368 | 7/1973 | Gledhill et al. | 37/236 |
| 3,808,714 | 5/1974 | Reissinger et al. | 37/233 |
| 4,127,951 | 12/1978 | Hatch | 37/236 |
| 4,236,329 | 12/1980 | Hetrick | 37/231 |
| 4,249,323 | 2/1981 | Mathis et al. | 37/236 |
| 4,288,932 | 9/1981 | Küper | 37/233 |
| 4,304,056 | 12/1981 | Watson et al. | 37/231 |
| 4,347,677 | 9/1982 | Küper | 37/233 |
| 4,528,762 | 7/1985 | Sarka et al. | 37/279 |
| 4,590,694 | 5/1986 | Block | 37/233 |
| 4,819,349 | 4/1989 | Mensch | 37/233 |
| 4,821,435 | 4/1989 | Pester | 37/231 |
| 4,907,358 | 3/1990 | Moore | 37/231 |
| 4,924,610 | 5/1990 | Sodemann | 37/231 |
| 4,962,598 | 10/1990 | Woolhiser et al. | 37/231 |
| 4,962,599 | 10/1990 | Harris | 37/231 |
| 4,999,935 | 3/1991 | Simi et al. | 37/234 |
| 5,014,451 | 5/1991 | Bandzul | 37/235 |
| 5,050,321 | 9/1991 | Evans | 37/236 |
| 5,081,775 | 1/1992 | Veilleux | 37/266 |

FOREIGN PATENT DOCUMENTS

| | | | |
|---|---|---|---|
| 81010 | 11/1952 | Norway | 37/272 |
| 177389 | 12/1961 | Switzerland | 37/283 |
| 1418390 | 8/1988 | U.S.S.R. | 37/266 |
| 1428783 | 10/1988 | U.S.S.R. | 37/266 |

OTHER PUBLICATIONS

Good Roads, Snow Removal Brochure, 1940.
Best of Farm Show Flyer, Dec. 1988.

*Primary Examiner*—Andrew V. Kundrat
*Assistant Examiner*—Spencer Warnick
*Attorney, Agent, or Firm*—Gregory Garmong

[57] ABSTRACT

A roadbed maintenance device includes a first frame adapted for attachment to the front end of a vehicle, and a second frame to which a moldboard is joined. The first frame and the second frame are pivotably joined by a parallelogram linkage, so that the second frame can be pivoted between a lowered position in which the lower edge of the moldboard touches the roadway, and a raised position in which the lower edge of the moldboard does not touch the roadway. The pivoting movement is preferably accomplished by biasing the second frame toward the raised position, and applying a force to accomplish pivoting toward the lowered position. The pivoting force is provided by a gas-actuated cylinder linked to the second frame, using a compressed gas source on the vehicle. The moldboard is desirably made of molded rubber.

15 Claims, 1 Drawing Sheet

ROADBED MAINTENANCE DEVICE

BACKGROUND OF THE INVENTION

This invention relates to an improved snowplow and roadbed maintenance device.

Snow removal from roadways has been a virtual necessity since the widespread adoption of the motorized vehicle.

To date, the general approach has been attaching a heavy steel plow by a hinge to the frame of a truck. The weight of the plow applies the downward pressure. A cable winch or hydraulic cylinder raises the plow blade for transport or for backing up. To handle the inevitable encounter with immovable objects, these blades are often equipped with another hinge and springs which allow the blade to "tip".

There are many disadvantages to this blade design. One of these disadvantages is that the inflexible nature of the blade can inflict damage to road surfaces, curbs, mailboxes, lawns, and any over-looked toys or tools which may have been covered by the snow. Another is that the weight of the plow, which must usually be set some distance in front of the truck, causes excessive wear on the front axle and also makes the vehicle difficult to steer. Moreover, when the plow is in the raised position, it obstructs the headlights, requiring additional lights to be mounted at a higher level.

There is a need for an improved type of snow plow and road maintenance device that avoids these disadvantages. The present invention fulfills this need, and further provides related advantages.

SUMMARY OF THE INVENTION

The present invention provides a roadway maintenance device having a first frame which may be attached to the front end of a vehicle, and a second frame to which a moldboard is joined. The first frame and the second frame are joined by a pivotable parallelogram linkage, so that the second frame can be pivoted between a lowered position in which the lower edge of the moldboard touches the roadbed surface, and a raised position in which the lower edge of the moldboard does not touch the roadbed surface. The pivoting movement is preferably accomplished by biasing the second frame toward the raised position, and applying a force to accomplish pivoting toward the lowered position. The pivoting force is desirably provided by a gas-actuated cylinder linked to the second frame, using a compressed gas source on the vehicle. Such compressed gas sources are commonly available on many 10-wheel type trucks with which the roadway maintenance device may be used. The moldboard is preferably made of corded rubber.

The moldboard is made light in weight, because the downward pivoting force, not the weight of the moldboard, provides the contact force with the roadway. The downward contact force is adjustable from inside the vehicle, by adjusting the compressed gas pressure. The plow is therefore operable in various conditions of snow, slush, and mud. The roadway maintenance device can also be effectively used for other maintenance functions such as spreading gravel, "squee-gee"ing shop floors and parking lots, de-slurrying logging roads, cleaning barns, and the like. If there is a failure of the compressed-gas source, the biasing mechanism raises the second frame and moldboard to the raised position, so that there is no damage to the roadway and so that the vehicle may be easily driven to a maintenance facility.

Because the moldboard may be made light in weight, the wear-and-tear on the front end of the vehicle is reduced as compared with more massive designs, and the roadway maintenance device may be mounted mid-frame on larger trucks. Steering of the truck is not hindered, as is the case with conventional plows. The small size of the moldboard and the short pivot distance required to clear the moldboard from the roadway permits the roadway maintenance device to be used with existing headlights, and without adding new lights.

The combination of a biased linkage suspension of the second frame and moldboard, together with the preferred rubberized construction of the moldboard, makes the roadway maintenance device forgiving of collisions with objects on or adjacent the roadway. Damage to the objects, the roadway maintenance device, and the vehicle to which it is mounted is reduced. The rubber construction of the moldboard reduces snow and ice buildup on the blade. The rubber construction also permits the moldboard blade to conform to the curvature of the roadway surface to a limited degree.

Other features and advantages of the invention will be apparent from the following more detailed description of the preferred embodiment, taken in conjunction with the accompanying drawing, which illustrates, by way of example, the principles of the invention.

DETAILED DESCRIPTION OF THE PREFERRED EMBODIMENT

Figure 1:
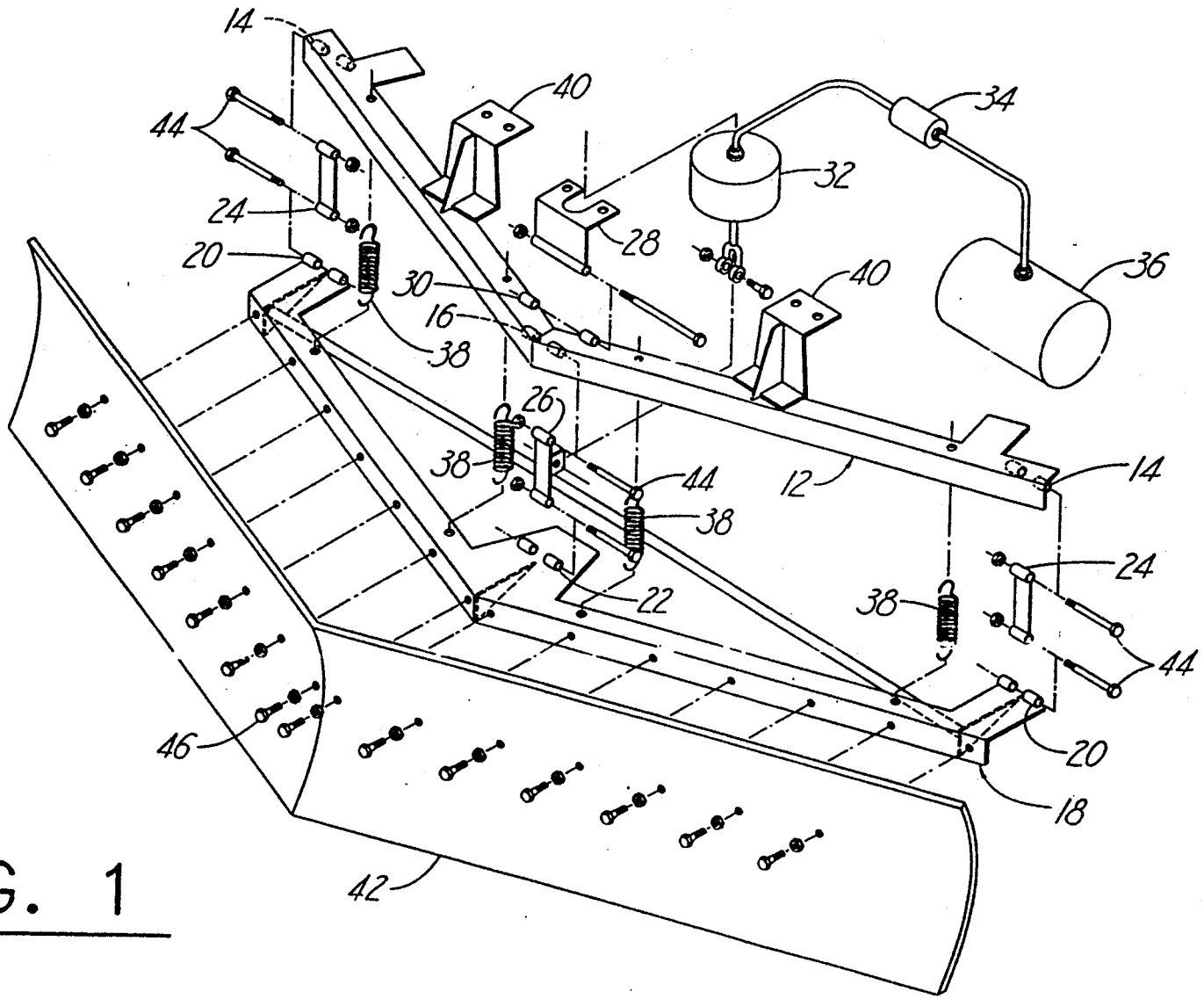
FIG. 1 is a perspective exploded view of a roadway maintenance device.

Referring to FIG. 1, a first frame 12 is preferably formed with the shape of two sides of a triangle when viewed from above. At the oppositely disposed ends of the first frame 12 are two first frame outer hinge pivots 14 whose hinge axes are collinear. A first frame intermediate hinge pivot 16 is positioned between the two outer hinge pivots 14, desirably at the apex of the first frame 12. The first frame intermediate hinge pivot 16 has its hinge axis parallel to, but not collinear with, the hinge axis of the two first frame outer hinge pivots 14. As illustrated in FIG. 1, the first frame intermediate hinge pivot 16 lies within the horizontal plane as the first frame outer hinge pivots 14.

A second frame 18 is preferably formed with the same basic configuration as the first frame 12, in the shape of two sides of a triangle of the same size as the first frame 12. At the oppositely disposed ends of the second frame 18 are two second frame outer hinge pivots 20 whose hinge axes are collinear. A second frame intermediate hinge pivot 22 is positioned between the two outer hinge pivots 20, desirably at the apex of the second frame 18. The second frame intermediate hinge pivot 22 has its hinge axis parallel to, but not collinear with, the hinge axis of the two second frame outer hinge pivots 20.

An outer linkage arm 24 extends from each first frame outer hinge pivot 14 to the respective second frame outer hinge pivot 20. An upper end of the outer linkage arm 24 engages the first frame outer hinge pivot 14, and a lower end of the outer linkage arm 24 engages the second frame outer hinge pivot 20. An inner linkage arm 26 extends from the first frame intermediate hinge pivot 16 to the second frame intermediate hinge pivot 22. An upper end of the inner linkage arm 26 engages the first frame intermediate hinge pivot 16, and a lower end of the inner linkage arm 26 engages the second frame intermediate hinge pivot 22. Each of the three linkage arms 24 and 26 is rigid, but is pivotably connected at the ends to the respective pivot with a hinge bolt 44, which acts to lock the parts of the hinge together and as the axis about which the hinge pivots.

The outer linkage arms 24, the inner linkage arm 26, the members of the first frame 12, and the members of the second frame 18 together form a pivotable parallelogram linkage. In operation, the first frame 12 is attached to a vehicle (not shown) by mounting brackets 40, and stays at a height above the roadway that is essentially constant. (The mounting brackets vary according to the vehicle. The illustrated brackets attach the roadbed maintenance device to a 1955 Dodge one-ton truck.) The linkage is pivotable between a lowered position where the second frame 18 is at a low point near the surface of the roadway and a raised position where the second frame 18 is raised rearwardly and away from the roadway.

The second frame 18 is biased toward the rearward, raised position by return springs 38 extending between the first frame 12 and the second frame 18. The return springs 38 may be anchored at each end near the respective hinge pivots, or elsewhere along the length of the frame.

The second frame 18 may be moved toward the forward, lowered position, against the spring bias, by application of an appropriate force. In the embodiment of FIG. 1, a gas-actuated cylinder 32 is mounted to a mounting bracket 28, which in turn is mounted to the first frame 12 at a mounting bracket pivot 30. The gas-actuated cylinder 32 may conveniently be a diaphragm-type brake actuating cylinder or a piston-type cylinder. The actuator end of the gas-actuated cylinder is fastened to the second frame 18 by a clevis pin. Gas pressure for the gas-actuated cylinder 32 is supplied from a gas reservoir 36 operating through a differential pressure valve 34. The gas reservoir can be filled as needed from an on-board compressor or any other source of compressed gas. The gas-actuated cylinder 32 preferably operates from compressed air. An advantage of the preferred approach is that, if the actuating system springs a leak, there is no dripping of a fluid.

A plow portion, properly termed a moldboard 42, is attached to the second frame 18 by a series of bolts 46. The moldboard 42 is preferably made of corded rubber. The moldboard is dimensioned and positioned on the second frame 18 so that the moldboard contacts the roadway when the gas-actuated cylinder 32 has been activated to move the second frame 18 to the lowered position. When the actuation force is removed, the second frame 18 moves upwardly and rearwardly as a result of the biasing force of the springs 38 to raise the moldboard out of contact with the road surface.

This preferred roadway maintenance device is simply mounted and dismounted from the vehicle, is clean in operation due to the use of air actuation, and highly versatile. The size of the roadway maintenance device can be varied according to the type of vehicle. The thickness of the moldboard material can be varied. The length of the linkage arms can also be varied. The V-angle of the moldboard can vary, and the moldboard can be hinged in the center to allow independent movement.

Although particular embodiments of the invention have been described in detail for purposes of illustration, various modifications may be made without departing from the spirit and scope of the invention. Accordingly, the invention is not to be limited except as by the appended claims.

What is claimed is:

1. A roadbed maintenance device operable in conjunction with a motor vehicle that rides on a roadway and utilizing a parallelogram linkage to support a moldboard, the roadway maintenance device comprising:

a first metal frame including means for rigidly attaching the metal frame to a motor vehicle, the first metal frame having two oppositely disposed collinear first frame outer hinge pivots and an intermediate first frame inner hinge pivot within the same horizontal plane as, but non-collinear with, the first frame outer hinge pivots;

a rigid second metal frame having two oppositely disposed collinear second frame outer hinge pivots and an intermediate second frame inner hinge pivot which is non-collinear with the second frame outer hinge pivots;

a pair of rigid outer linkage arms, each outer linkage arm being pivotably attached at one end to one of the first frame outer hinge pivots, and at the other end to one of the second frame outer hinge pivots;

a rigid inner linkage arm pivotably attached at one end to the first frame inner hinge pivot and at the other end to the second frame inner hinge pivot, the pair of outer linkage arms, the inner linkage arm, the first metal frame and the second metal frame together forming a parallelogram linkage comprising rigid members pivotably attached together at their respective ends, the rigid parallelogram linkage being operable to swing from a raised position when the linkage arms are pivoted rearwardly with respect to the vehicle to a lowered position when the linkage arms are pivoted forwardly with respect to the vehicle;

a moldboard attached to the second frame, the moldboard being dimensioned such that a lower edge of the moldboard contacts the roadway when the parallelogram linkage is in the lowered position, and is raised out of contact with the roadway when the parallelogram linkage is in the raised position; and means for moving the parallelogram linkage between the lowered and raised positions.

2. The roadbed maintenance device of claim 1, wherein the moldboard is made of corded rubber.

3. The roadbed maintenance device of claim 1, wherein the means for moving the parallelogram linkage includes means for biasing the parallelogram linkage toward the raised position, and means for controllably acting against the means for biasing to move the parallelogram linkage toward the lowered position.

4. The roadbed maintenance device of claim 1, wherein the means for moving the parallelogram linkage includes a gas-actuated cylinder linked to the second frame.

5. The roadbed maintenance device of claim 4, further including a source of compressed gas for the gas-actuated cylinder and a control valve that regulates the flow of gas from the source of compressed gas to the gas-actuated cylinder.

6. The roadbed maintenance device of claim 4, wherein the gas-actuated cylinder is a diaphragm-type brake actuating cylinder.

7. The roadbed maintenance device of claim 4, wherein the gas-actuated cylinder is a piston-type brake actuating cylinder.

8. The roadbed maintenance device of claim 1, wherein each of the first and second frames has an inverted V-shape when viewed in plan view.

9. A roadbed maintenance device operable in conjunction with a motor vehicle that rides on a roadway, comprising:

a first metal frame including means for rigidly attaching the metal frame to a motor vehicle;

a second metal frame;

linkage means formed of rigid members pivotably attached together for linking the first metal frame and the second metal frame in a parallelogram linkage, the linkage means being pivotable such that the second metal frame moves from a lowered position to a raised position;

a moldboard attached to the second frame, the moldboard being dimensioned such that a lower edge of the moldboard contacts the roadway when the second metal frame is in the lowered position and is raised out of contact with the roadway when the second metal frame is in the raised position; and means for moving the second metal frame between the lowered and raised positions, the means for moving including means for biasing the second metal frame toward the raised position, and powered means for controllably acting against the means for biasing to move the second metal frame toward the lowered position.

10. The roadbed maintenance device of claim 9, wherein the moldboard is made of corded rubber.

11. The roadbed maintenance device of claim 9, wherein the means for moving the second metal frame includes a gas-actuated cylinder linked to the second frame.

12. The roadbed maintenance device of claim 11 further including a source of compressed gas for the gas-actuated cylinder and a control valve that regulates the flow of gas from the source of compressed gas to the gas-actuated cylinder.

13. The roadbed maintenance device of claim 11, wherein the gas-actuated cylinder is a diaphragm-type brake actuating cylinder.

14. The roadbed maintenance device of claim 11, wherein the gas-actuated cylinder is a piston-type brake actuating cylinder.

15. The roadbed maintenance device of claim 9, wherein each of the first and second frames has an inverted V-shape when viewed in plan view.

* * * * *